US011657671B2

(12) United States Patent
Wydra et al.

(10) Patent No.: US 11,657,671 B2
(45) Date of Patent: May 23, 2023

(54) GAMING MACHINE AND METHOD WITH GROUP GAMING MODE

(71) Applicant: Everi Games, Inc., Austin, TX (US)

(72) Inventors: Jason R. Wydra, Forest Park, IL (US); Jason Y. Chan, Chicago, IL (US); Juan Mariscal, Chicago, IL (US); Brent A. Walker, Chicago, IL (US); Michael Stephen Cook, Chicago, IL (US); Lynn H. Wang, Escondido, CA (US); Jeremy Wright, Chicago, IL (US)

(73) Assignee: Everi Games, Inc., Austin, TX (US)

( * ) Notice: Subject to any disclaimer, the term of this patent is extended or adjusted under 35 U.S.C. 154(b) by 506 days.

(21) Appl. No.: 16/600,357

(22) Filed: Oct. 11, 2019

(65) Prior Publication Data

US 2021/0110647 A1 Apr. 15, 2021

(51) Int. Cl.
*G07F 17/32* (2006.01)
*G07F 17/34* (2006.01)

(52) U.S. Cl.
CPC ..... *G07F 17/3225* (2013.01); *G07F 17/3209* (2013.01); *G07F 17/3213* (2013.01); *G07F 17/3244* (2013.01); *G07F 17/3267* (2013.01); *G07F 17/3258* (2013.01); *G07F 17/34* (2013.01)

(58) Field of Classification Search
CPC ..... G07F 17/3225; G07F 17/3213; G07F 17/3244; G07F 17/3267; G07F 17/3209
See application file for complete search history.

(56) References Cited

U.S. PATENT DOCUMENTS 5,816,915 A * 10/1998 Kadlic ..... G07F 17/32 463/13
2004/0192431 A1* 9/2004 Singer ..... G07F 17/3244 463/20
2006/0189381 A1* 8/2006 Daniel ..... G07F 17/3232 463/29
2007/0024002 A1* 2/2007 McMain ..... G07F 17/32 273/274
2010/0029381 A1* 2/2010 Vancura ..... G07F 17/3244 463/30
2011/0159940 A1* 6/2011 Acres ..... G07F 17/3276 463/11
2016/0328915 A1* 11/2016 Cannon ..... G07F 17/32

OTHER PUBLICATIONS

N-Mark Spade Panel, available at least by Jun. 29, 2019, available at <<https://web.archive.org/web/20190629135600/https://www.mariowiki.com/N-Mark_Spade_Panel>> (Year: 2019), 1 page.*

* cited by examiner

*Primary Examiner* — Thomas H Henry
(74) *Attorney, Agent, or Firm* — Nathan H. Calvert; The Culbertson Group, P.C.

(57) ABSTRACT

A gaming machine, method, and program product provide a slot machine game with group gaming mode features. A set of gaming machines enter a group gaming mode in which prize objects are displayed on a group mode game board and are available to be awarded to individual gaming machines in the set, and are then removed from the group mode game board. Primary game results at each of the set of gaming machines are presented through the group gaming mode.

20 Claims, 10 Drawing Sheets

GAMING MACHINE AND METHOD WITH GROUP GAMING MODE

FIELD OF THE INVENTION

This invention relates to gaming systems and to gaming machines through which players may participate in wagering games, and in particular gaming machines including group games.

BACKGROUND

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or entirely different graphics. Many video-based gaming machines have three or five spinning reels that may be stopped to display a matrix of game symbols. The symbols displayed on the stopped reels correlate to a result of the game. Video-based gaming machines may also be used to show card games or various types of competitions such as simulated horse races in which wagers may be placed.

Group games are used with slot machines to improve the variety of prizes and game playing experiences available. For example, some games provide that a bank of gaming machines enter a group bonus mode in which higher value prizes are awarded. Other games provide a group event that is similar to a tournament, in which high value prizes are awarded to certain individual gaming machines that obtain better results while wagering in the group mode. Group bonuses are often triggered by some event at one or more of the gaming machines in the group, while tournament style group games may be scheduled.

Game manufacturers are continuously pressed to develop new game presentations, formats, and game graphics in an attempt to provide high entertainment value for players and thereby attract and keep players. What is needed are ways to provide both anticipation and excitement to players while providing more variability in game results.

SUMMARY OF THE INVENTION

The present invention includes wagering games, gaming machines, networked gaming systems, and computer programs that provide improvements to group games played on slot machines or other gaming machines. A set of gaming machines enter a group gaming mode in which prize objects are displayed on a group mode game board and are available to be awarded to individual gaming machines in the set, and are then removed from the group mode game board. Primary game results at each of the set of gaming machines are presented through the group gaming mode.

According to one aspect of the invention, a method is performed with a group of gaming machines, each including one or more displays, a wager input device, and at least one electronic controller operatively coupled to the wager input device and the one or more displays and configured to execute instructions for providing a wagering game. The method includes operating the gaming machines in a first mode in which wager results of a primary game are presented in a primary display area, and wager results have a chance of including bonus events including a presentation on a secondary display area of the one or displays. In response to a mode change event, the method includes operating a set of two or more of the gaming machines in a second group gaming mode in which the secondary display areas of the set of gaming machines include a common, persistent game board with a plurality of prize objects. The second group presentation mode includes (i) obtaining primary game results for wager activations at the set of gaming machines, the primary game results having a chance to include a prize amount, (ii) providing selected primary game results at least partially in the game board by awarding at least one of the prize objects and an associated prize amount to one of the group of gaming machines to provide the primary game result prize amount, (iii) for each prize object awarded, causing a message to be sent to the other gaming machines of the set that the at least one prize object has been taken, displaying an indication at the other gaming machines of the set that the at least one prize object is no longer available, and removing it from the game board, and (iv) when a prize object is awarded, maintaining available prize distributions of the primary game for all gaming machines in the set.

Another aspect of the invention is a gaming machine including a display, an audio device, a wager input device, and at least one electronic controller operatively coupled to the wager input device, the audio device and the display and configured to execute instructions related to the wagering game and to cause cash value credits to be awarded to a player in response to wagering wins. A tangible, non-transitory electronically accessible memory is connected to the at least one electronic controller and contains program code executable by the at least one electronic controller for performing the method.

Another aspect of the invention is a computer program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. The program also has game controller program code for determining game play results involving spins or other randomization of primary game presented through a first gaming mode and group gaming mode game presentations according to the method above.

Another aspect of the invention is a gaming system that includes one or more gaming servers, and a group of electronic gaming machines connected to the servers by a network, programmed to provide one of more of the methods described herein. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results to present the results received from the server in an entertaining manner. However, other embodiments of course might use a thin client architecture in which the animation is also conducted by the server and electronic gaming machines serve merely as a terminal to receive button or touchscreen input from the player and to display graphics received from the server.

Different features may be included in different versions of the invention. These and other advantages and features of the invention will be apparent from the following description of the preferred embodiments, considered along with the accompanying drawings.

DETAILED DESCRIPTION OF EXAMPLE EMBODIMENTS

Figure 1:
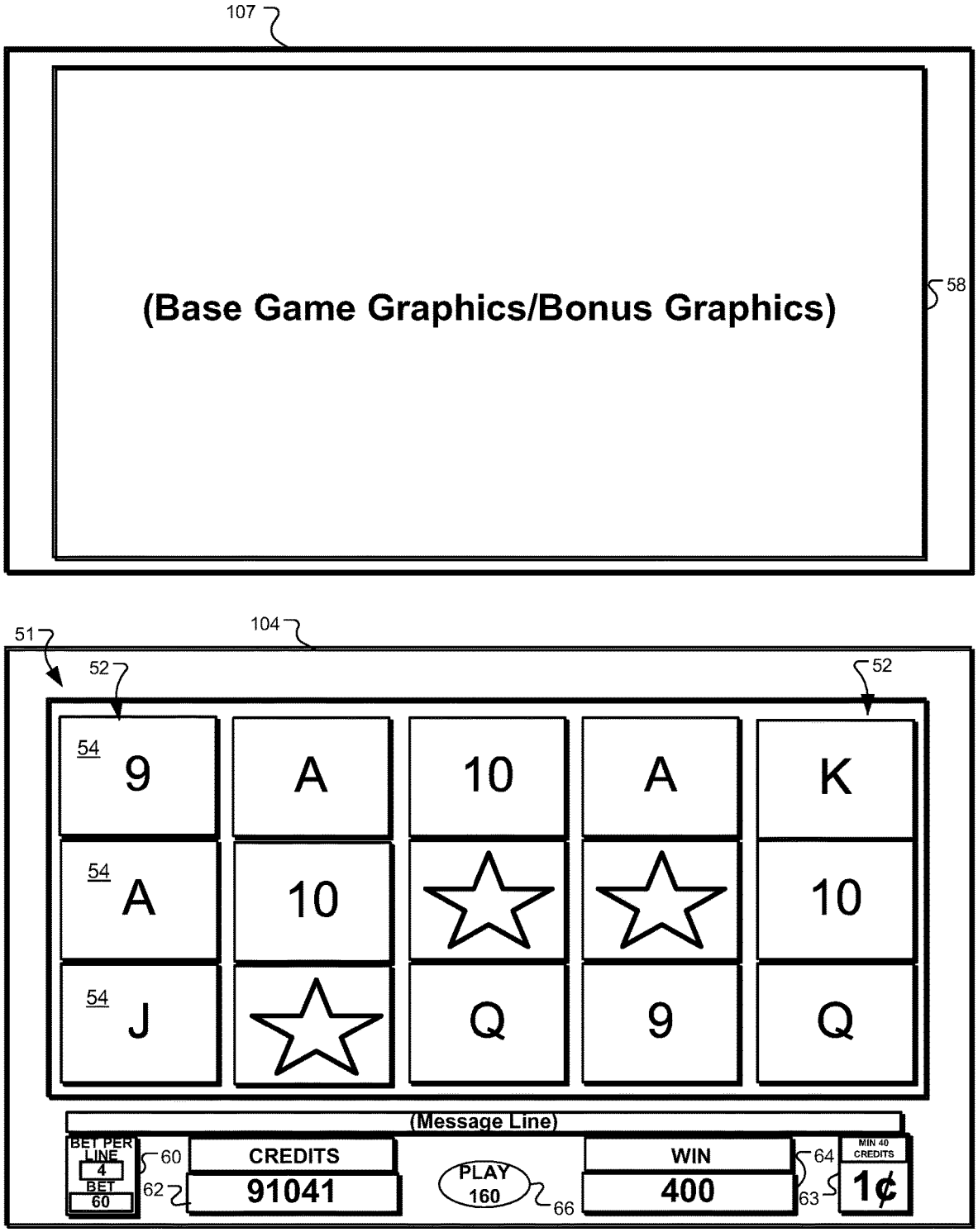
FIG. 1 is a game screen diagram showing a base game mode having multiple game presentations according to an example embodiment.

FIG. 1 is a game screen diagram illustrating a base game mode showing the primary display 104 ("primary display", "primary display area") and the top, secondary display 107 to illustrate an example slot machine display arrangement on which wagering game results are presented in a gaming area, typically found on the primary display. A secondary display area 58 is present on secondary display 107, or if a single tall display is used, the secondary display area is typically located toward the top of the display and the primary display area is located toward the bottom of the display.

The primary display area of a reel-type primary game (as opposed to bonus games or other feature games as described herein) in this version is a matrix 51 of symbol locations arranged in rows and columns to represent simulated slot machine reels that are spun to conduct a game round. Other embodiments may, of course, use other types of game displays to display randomizing of symbols according to the methods herein. The depicted columns of symbols labeled 52 represent the simulated reels, while symbols are shown in each symbol location designated 54. In this instance there are five reels with three symbol locations 54 displayed at a time on each reel, but the game can be played with more and less reels. The simulated reel typically has far more symbols than those displayed, and as many unique stop positions as there are symbols on the simulated reel. The stop position may be counted, for example, by numbering the symbols on the simulated reel and using the number of the symbol at the bottom of the display window (the three symbols displayed in this example), or at the top or middle. Further, while multi-symbol reels are shown, other versions may use simulated uni-symbol reels, or a reel that has many symbols thereon but only a single window to the reel simulated, displaying a single symbol from the reel. Some variations of the present invention may use a simulated uni-symbol reel in each depicted symbol location 54. Winning patterns are typically formed by matching symbols along defined paylines that pass through the matrix 51.

Below matrix 51 is box 60, which displays the current wager and amount bet per payline. Other versions may not have a designated bet per line. To the right of box 60 is box 62, which displays the current credits in the player's account. In the bottom center a touchscreen play button 66 is presented in the lower central area of the display, which may show other game state related graphics. Right of this is win box 64, which displays the player's last awarded winnings. The wager credit denomination is shown in box 63. Along the bottom edge of the matrix 51 there is a message line, where the game station can display further instructions to the player.

Figure 2A:
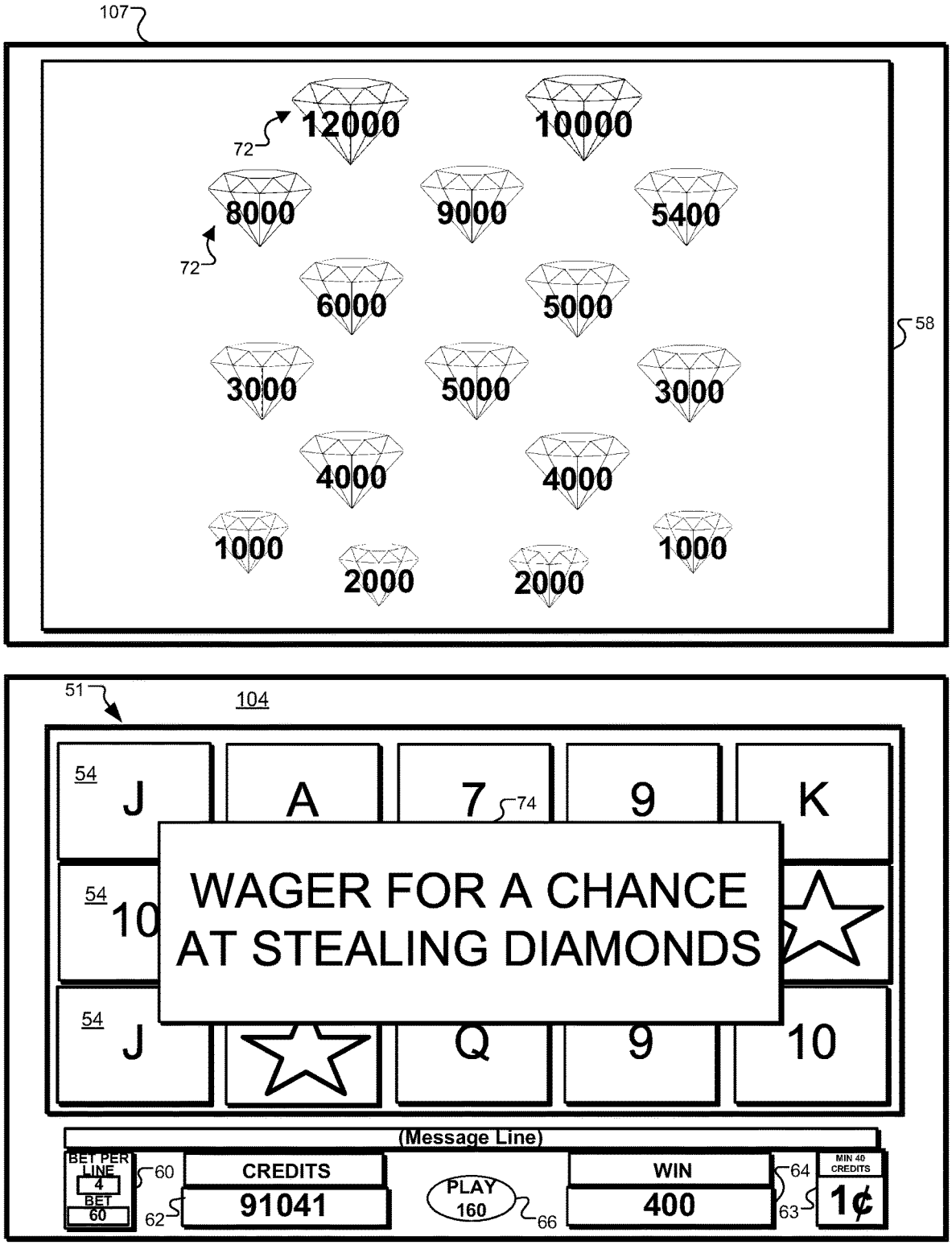
FIGS. 2A-2C are a sequence of bonus round screen diagrams according to an example embodiment.
Figure 2B:
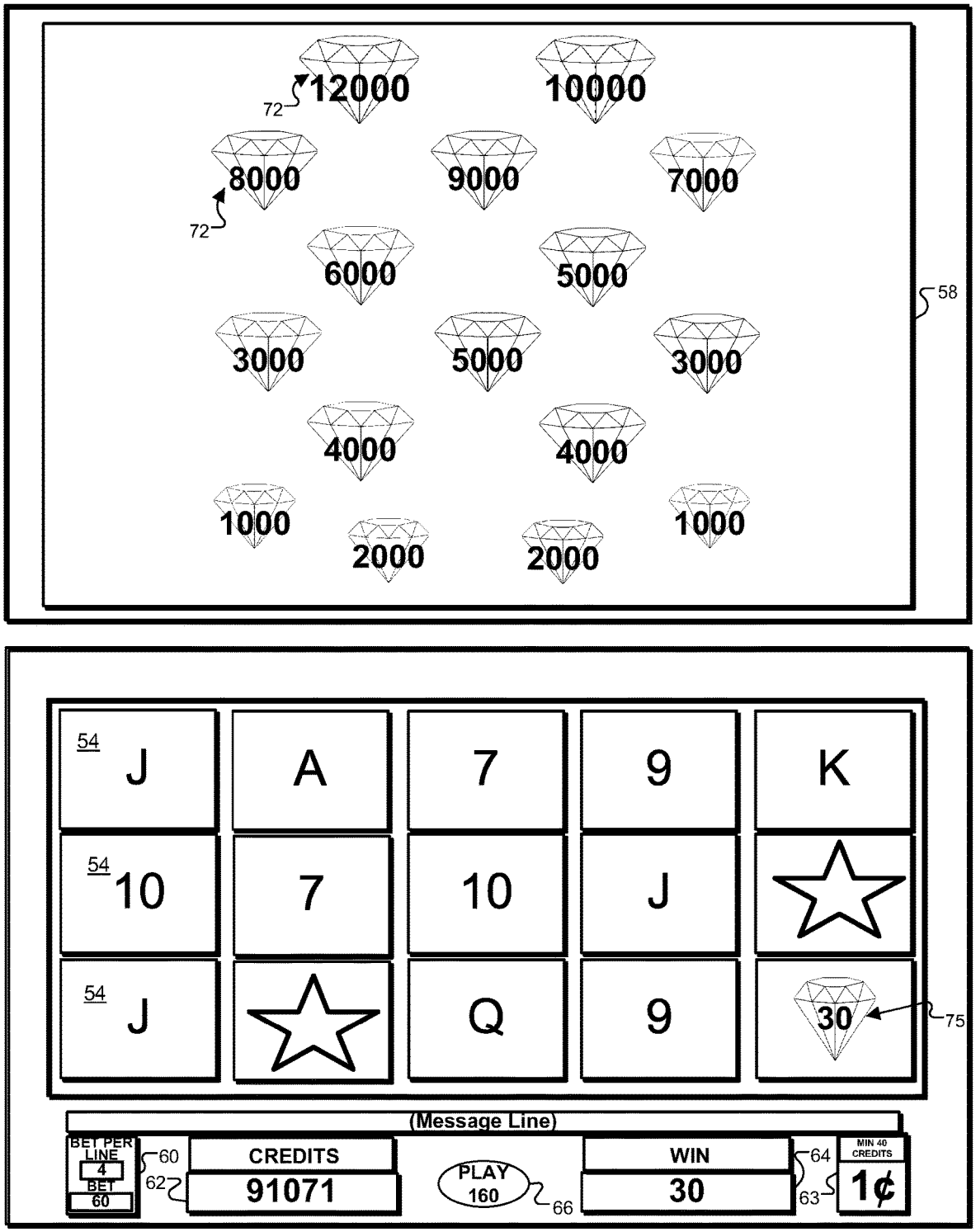
Figure 2C:
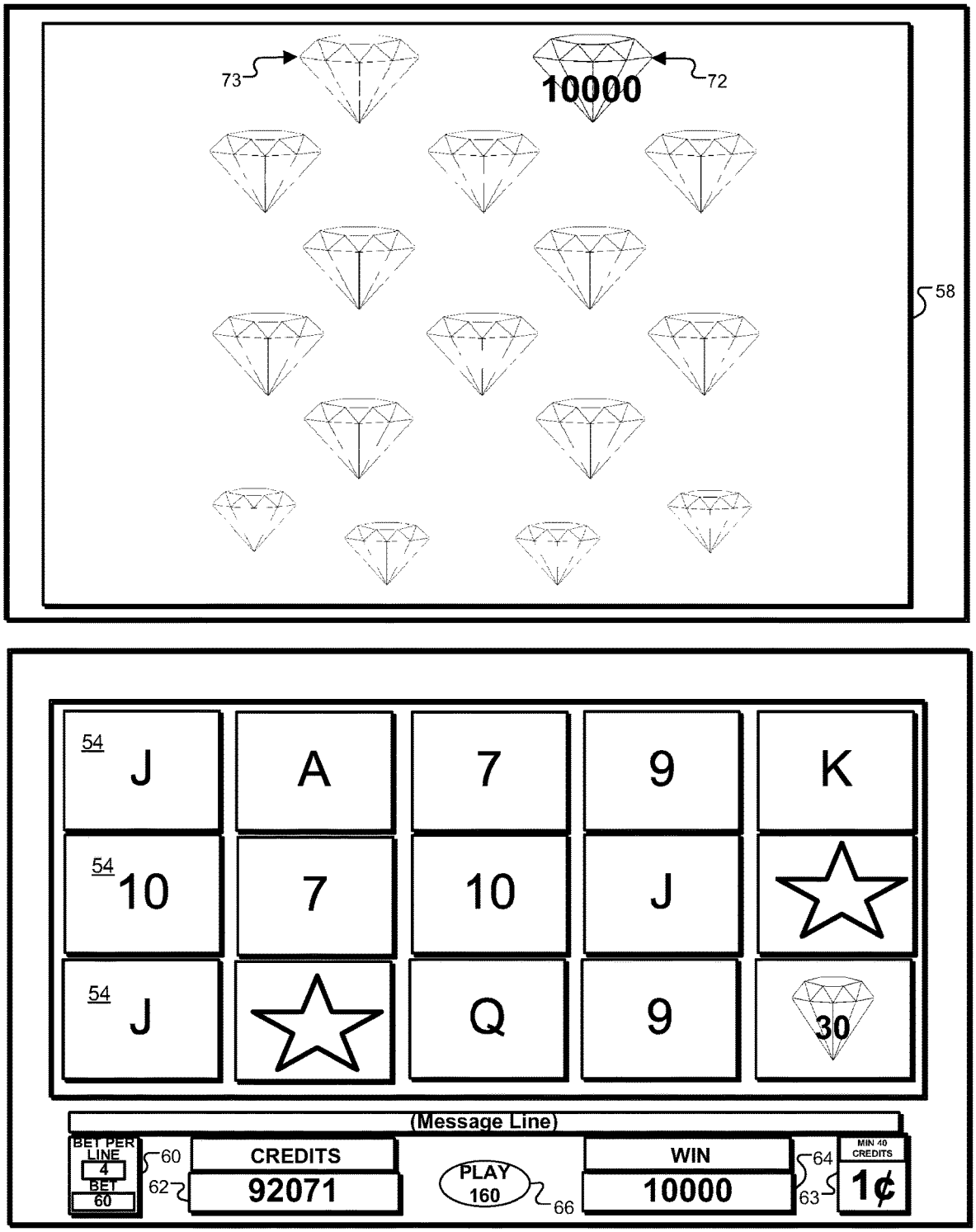

FIGS. 2A-2C are a sequence of game screen diagrams illustrating a group gaming mode according to some embodiments. The sequence depicts operation in a second group gaming mode in which the secondary display areas of a set of gaming machines include a common, persistent game board with a plurality of prize objects 72. The matrix of symbol locations 51 in primary display area 104 continues to present primary game results in the group gaming mode, in cooperation with secondary display area 48. The operation of the group gaming mode is described below referring to FIGS. 2A-2C and FIG. 3.

While a set of prize objects with known depicted prize values is shown in this example, prize objects 72 may also include prize objects without a displayed prize value, such as a progressive prize or other special prizes labelled "Grand Prize", "Major Prize", or the like.

Figure 3:
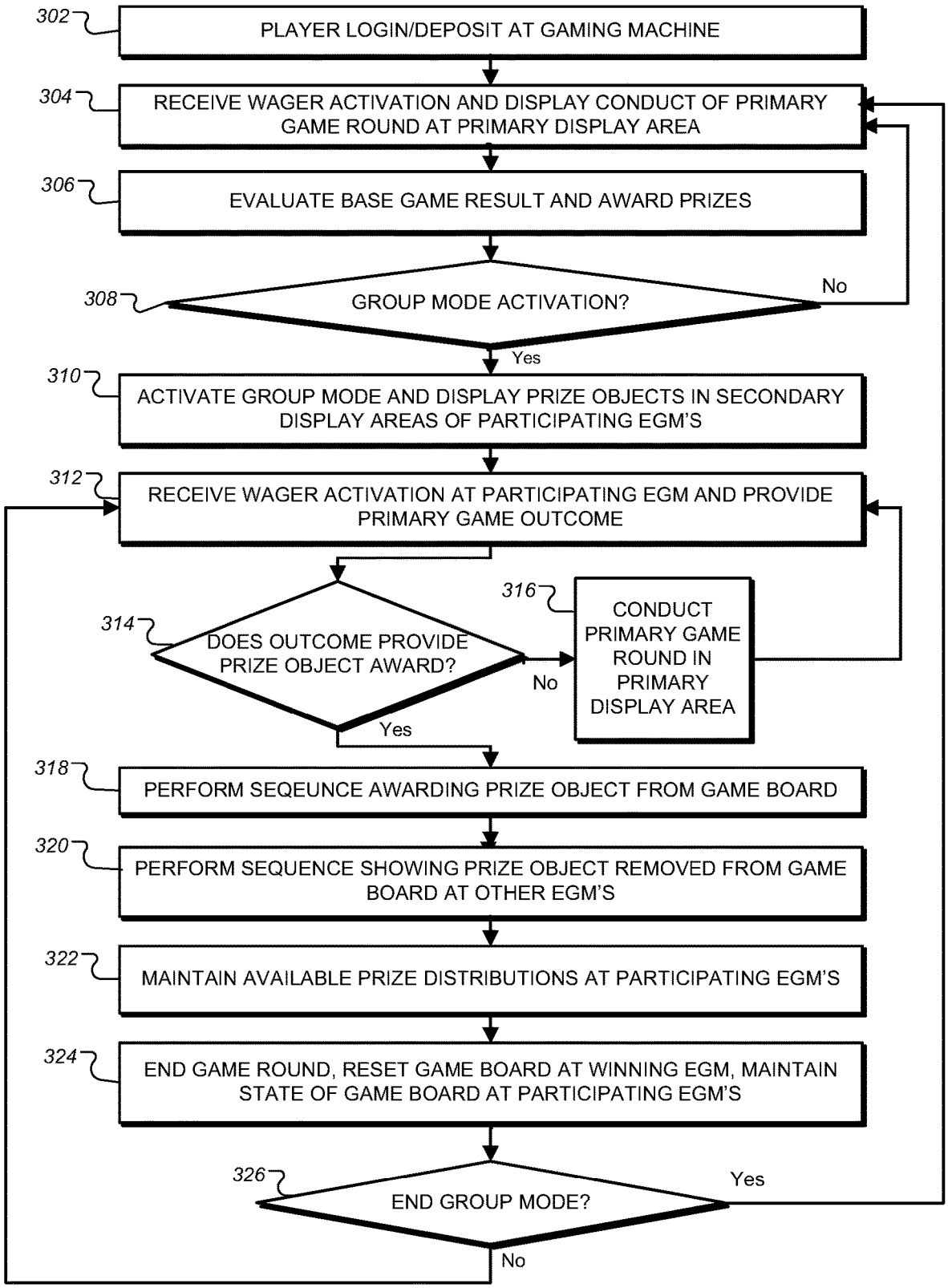
FIG. 3 is a flowchart of a process for providing a base game according to an example embodiment.

FIG. 3 is a flowchart showing a process for providing a wagering game according to one or more embodiments of the invention. Generally, the process is conducted under control of one or more electronic processors to present gaming results on one or more displays on a gaming machine such as those described herein. To initialize the game and make it available for wagering, the process starts a game engine software package for executing game code like that depicted in FIG. 4, including loading data structures such as media assets and code for a first gaming mode and a second group gaming mode. The process of providing a wagering game for a player starts at block 302 where a player logs in or deposits money or a credit voucher at a gaming machine. This typically includes receiving the player deposit through a credit input device such as the bill/voucher acceptor 112 (FIG. 6), and in response activating a credit meter value that establishes a player credit balance.

To begin a game play in the first gaming mode, the method receives a wager activation on a player input device at the gaming machine at block 304, which typically consists of some input from the player to set the amount to be wagered from their credit amount on the machine. The wager amount may also be carried over from previous game rounds by simply starting the game with the previous wager amount set. This typically happens through a 'Play' button (110, FIG. 6) on the game cabinet or touchscreen display, and serves to place the wager and start a single round of game play in the base game at block 304. In embodiments having reels, reel displays, or simulated reels, this is conducted by spinning the reels. Other embodiments may otherwise rearrange or randomize the symbols on the matrix in any suitable manner. For games that use other methods of scrambling the matrix besides simulated reels, the random outcome is determined at this step as appropriate for the game. The preferred version generates at least one random number and uses the at least one random number to determine a prize amount and a set of game reel stops, which is fed to a first data structure for providing the game presentation. The base game outcome includes a possibility of winning money value credits and a possibility of winning a bonus game outcome. The game outcome is evaluated at block 306 by displaying an evaluation of the symbols on the matrix for winning patterns and other winning symbols or combinations thereof.

After each primary game round is completed, at block 308 the process checks to determine if a group mode activation has occurred. If no mode change has occurred, the process returns to block 304 and continues receiving wager activations and providing primary game results. In this embodiment, a group mode activation occurs when a group mode plugin service activates it, as described with respect to the process of FIG. 5. In other embodiments, other events may trigger a group mode activation.

If the group mode activation occurs, the process goes to block 310 where it begins operating a set of two or more of electronic gaming machines (EGM's) as a group in which the secondary display areas of the set of gaming machines include a common, persistent game board with a plurality of prize objects. Data structures for displaying and performing the second gaming mode are activated for all gaming machines in the set. The set of gaming machines is typically part of a group or "bank" of adjacent machines on the casino floor, arranged side by side or in a circle. To begin the group mode at block 310, each gaming machine in the set displays a graphic sequence including the appearance of prize objects 72 (FIG. 2A) on secondary display area 58, and a message 74 indicating that the player should wager to participate in the secondary bonus game, in this example a "Diamond Rush" theme in which wagers in the primary game during the group mode have the opportunity to "steal" a diamond from the group of diamond prize objects 72 presented at the secondary display areas of the machines.

Next at block 312, the process receives wager activations at the participating gaming machines, and provides a primary game outcome to the wagering machine for each wager activation having a chance to include a prize amount. It is noted that fulfilling wager activations for a set of machines is discussed, each machine typically has its own instantiation of game engine software running the depicted process to fulfill the functions of the gaming machine. Multiple machines are discussed merely to illustrate the group mode, and are not typically all handled by the same executing software. At block 314, the outcomes are evaluated to determine if they qualify for a prize object award, presented at the secondary display area. In this embodiment, primary game results that qualify for a prize object award are those that would have qualified for a bonus prize or respin round during the ordinary base game mode. These outcomes have a higher associated credit prize than awards which only include a prize presented on the primary display area 104 (FIG. 2A). The larger prize is presented as an award of a prize object in the group gaming mode. In other embodiments, other events in the primary game may qualify for a prize object award.

If no prize object award is due at block 314, the process goes to block 316 where it conducts the primary game round in the primary display area 104 and presents any prizes due through winning outcomes on the matrix of symbol locations 51. Then the process returns to block 312 to await further wager activations.

If a prize object award is due to the primary game outcome at block 314, the process goes to block 318 where it performs a graphic sequence including the primary and secondary display areas and showing the award of a prize object from the group game board depicted at secondary display area 48. FIG. 2B shows state of the primary display area 104 and secondary display areas 58 after block 312 but before block 318. A primary game result is presented on the matrix of symbol locations 51. In this example the primary game result includes a symbol not available in the first gaming mode, a diamond symbol 74. Such unique symbols or animations may be added to the primary game presentation in the group gaming mode. In FIG. 2B, a primary game result is presented with a win of 30 credits due to the diamond symbol 30. However the primary game result in this example included a respin round with a 10,000 credit prize. Consequently, in the second game mode, instead of a respin, the game proceeds to display the award of a prize object 72 from the game board.

As shown in FIG. 2C, the award of a prize object at block 318 may include a graphic sequence in which non-awarded prize objects 73 are greyed out of otherwise deemphasized in the game board (only for the gaming machine receiving the award), and ending with the awarded prize object 72 emphasized as shown. Other embodiments may include other graphic sequences to depict the prize object 72 awarded, such as highlighting and animations of the awarded prize object 72. The credit amount depicted for the awarded prize object 72 is credited to the player. One or more prize objects may be awarded, which along with the primary game outcome displayed in the primary display area 104, add up to the prize amount due for a particular primary game outcome.

Next at block 320, the process performs a graphic sequence showing the prize object 72 being removed from game boards at the other gaming machines in the group. Preferably this sequence occurs simultaneously to the award of the prize object 72 at block 318. In this embodiment, the removal is accomplished by greying out the removed prize object 72 and adding a label on it indicating it has been "stolen" or otherwise taken by another player. This process tends to encourage wagering at a fast rate during the group gaming mode, because the prizes on the group game board appear to be "up for grabs" or available to the first player at the set of participating gaming machines to win them.

In reality, the available prize distribution at each participating gaming machine is maintained after each award, as shown at block 322, even though a prize object is shown to be removed from the board. This process removes the awarded prize objects such that they are not available to be awarded for the remainder of the group gaming mode, but any particular prize amount due to a primary game outcome is awarded by either a prize award presented in primary display area 104, a prize amount presented with one or more prize objects awarded in secondary display area 58, or a combination of the two.

At block 324, the process ends the game round for the wager activation being presented, and resets the group game board for the winning gaming machine by returning all the non-awarded prize objects 73 (FIG. 2C) to their normal visible state. The group game boards at the remaining gaming machines in the set are maintained with the removed prize objects continuing to show that they have been taken.

Figure 5:
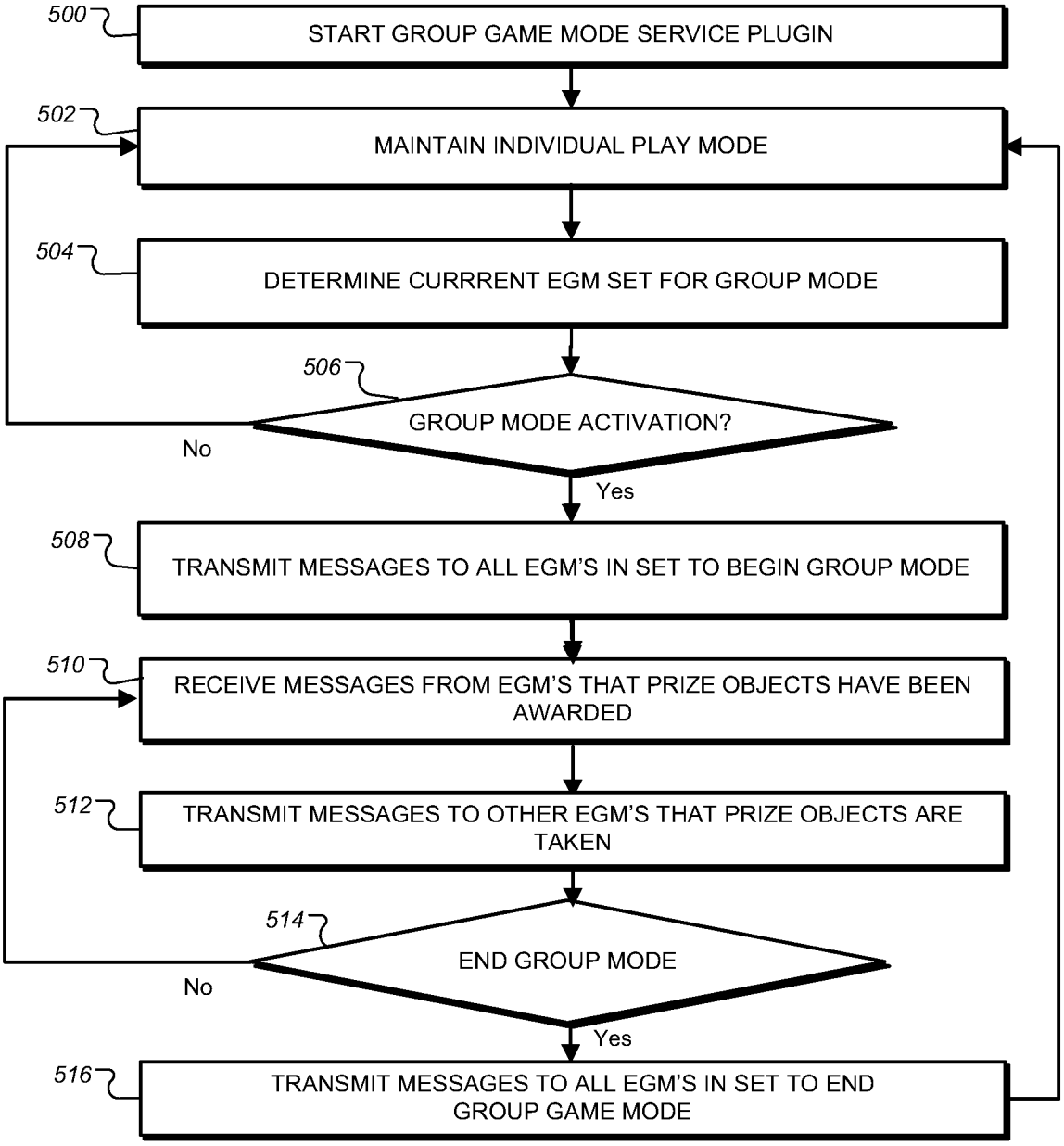
FIG. 5 is a flow diagram of a process for operating a group gaming mode messaging service plugin according to some embodiments.

Next at block 326 the process checks whether the group gaming mode has ended. In some embodiments, the group gaming mode is ended when all of the prize objects have been awarded. In other embodiments, the group gaming mode lasts for a designated time period controlled by the group gaming mode plugin service (FIG. 5). If the group gaming mode is ended, the process returns to block 304 where all the gaming machines in the set are returned to their normal individual play modes, receiving and processing wager activations with results presented as normal primary game results with possible bonus awards and respin awards. If the group gaming mode is not ended at block 326, the process returns to block 312 to process wager activations in the group mode. The check at block 326 typically applies to all participating gaming machines, such that if the group gaming mode is ended while a game outcome is being presented, the game outcome presentation is finished according to the group gaming mode process, and then all participating machines are returned to individual game mode.

Figure 4:
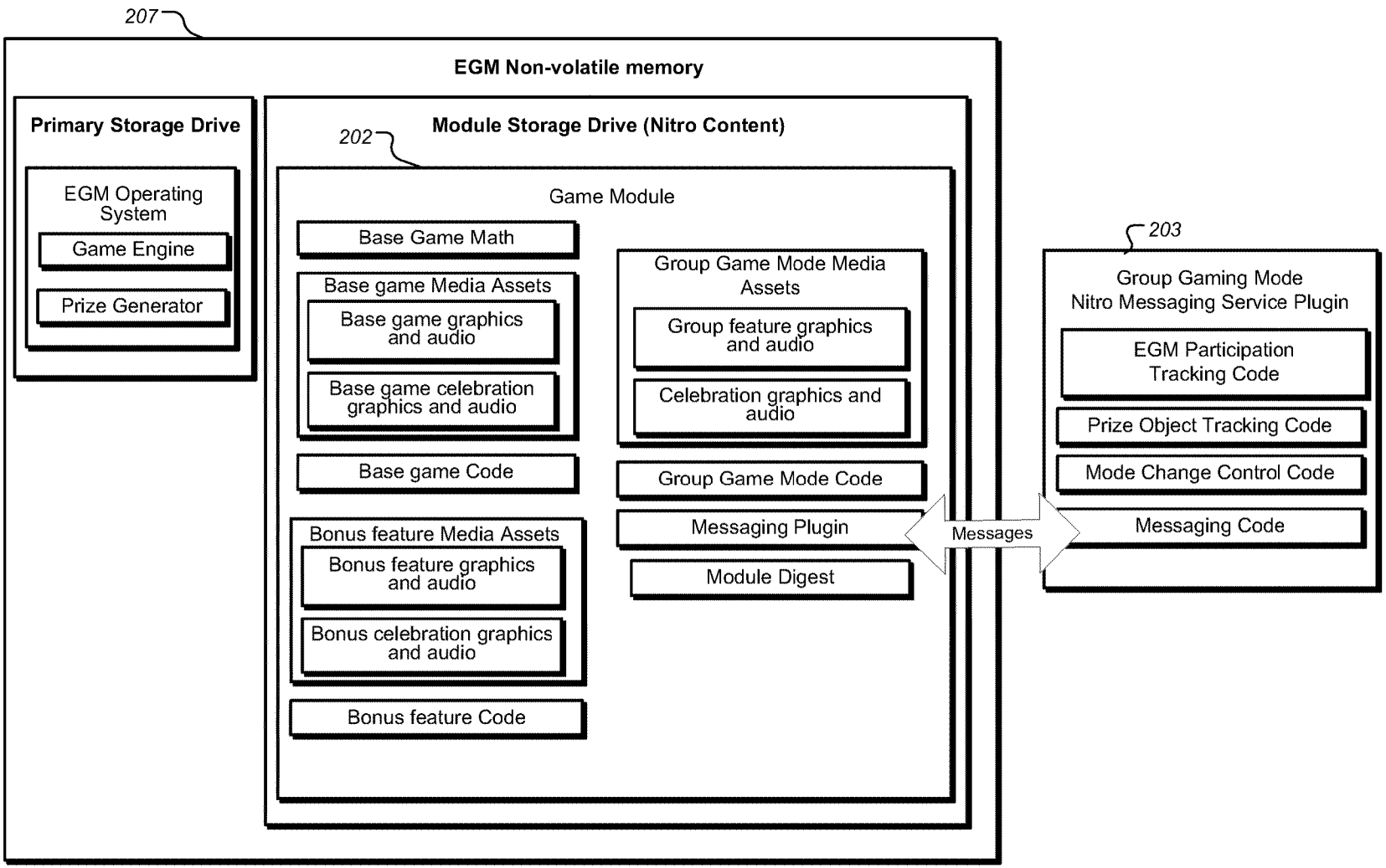
FIG. 4 illustrates in block diagram form a software and data structure design for the electronic gaming machines and the group messaging mode messaging service which coordinates the group gaming mode and manages the game board during the group gaming mode according to some embodiments.
Figure 8:
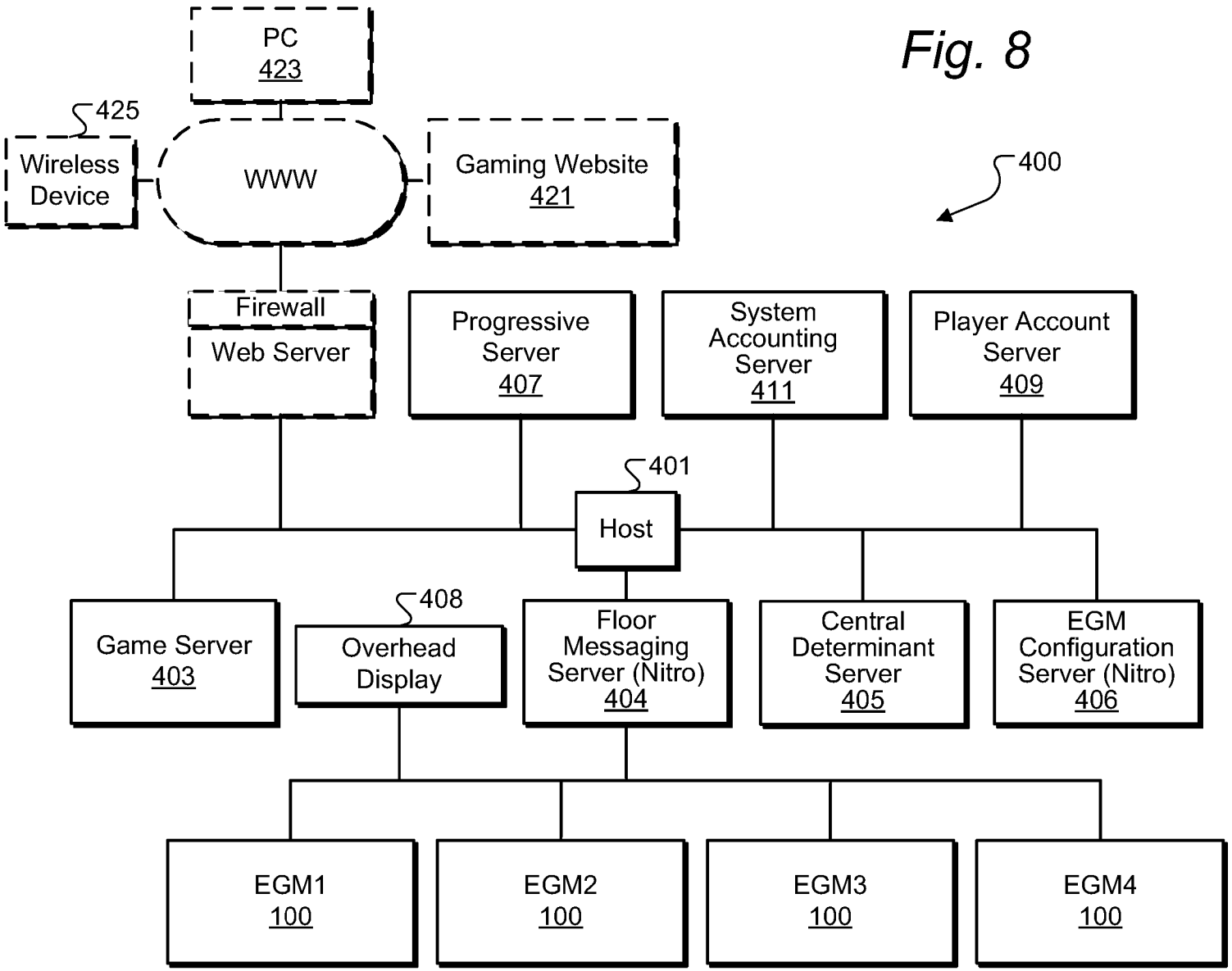
FIG. 8 is a system block diagram of a gaming system according to one embodiment of the present invention.

FIG. 4 illustrates in block diagram form a software and data structure design for the electronic gaming machines and the group messaging mode messaging service which coordinates the group gaming mode and manages the game board during the group gaming mode. The contents of non-volatile memories 207 at each of the electronic gaming machines in the group. A primary storage drive holds the EGM operating system and a game engine and may include a prize generator for producing randomized game outcomes, either with a random number generator or by request to a gaming outcome server such as central determinant server 405 (FIG. 8). In this embodiments, the game engine is the Nitro™ game engine provided by Everi Games, Inc., which interacts with a Nitro game server for managing installed games, and various Nitro messaging services for managing group presentations and group mode gaming such as tournaments, group gaming modes like those herein, and other group game presentations across multiple gaming machines.

A gaming module storage drive, in this embodiment the Nitro Content drive, holds the software and data structures for providing particular games, embodied in a game module 202. As shown in the drawing, typically the game modules 202 is added to separate module storage drive than the drive which stores EGM game engine, but this is not limiting, and other security measures may instead be used. This separated storage arrangement allows a configuration server to access the module storage drive for configuring the gaming machine.

Game module 202 includes at least first data describing game math for describing the mathematical response to random numbers or randomly generated prizes provided by the prize generator. The base or primary game math data in module 202 includes including bonus wager data and bonus payout data and definitions of the mathematical probabilities or operations to produce bonus game results based upon random numbers generated for game results. Game module 202 also base game code for executing the logic and rules of the primary game, which is preferably script code executed by a script engine portion of the game engine, but may in other embodiments be another type of program code such as executable code executed directly by the EGM processor. Game module 202 also includes base game media assets with digital media data including graphics and audio for all media features and sequences to be employed for executing the primary game results and any related media presentations such as the depicted bonus celebration graphics and audio.

Depicted below the base game code are bonus feature media assets and bonus feature code for executing bonus features such as bonus awards displayed in secondary display area 58, and respin awards, for example. Bonus features graphics and audio media are included and along with celebration graphics and audio for presenting bonus awards.

Also shown in game module 202 are group gaming mode media assets and group gaming mode code. The media assets include the group gaming mode graphics and audio, such as the prize object graphics and animations for presenting the game board of the group gaming mode. Celebration graphics and audio contain the media assets needed to present prize awards in the group gaming mode.

The group gaming mode code includes the executable code required to present the group gaming mode as described with respect to FIG. 3. The group gaming mode code interacts with a messaging plugin to manage the activation and deactivation of the group gaming mode, and to track the prize objects 72 presented on the group game board through messaging with the group gaming mode messaging service plugin 203.

In this embodiment, the group gaming mode messaging service plugin 203 is a service running on a nitro floor messaging server 404 (FIG. 8) or other suitable messaging server for coordinating group gaming activity. The messaging service plugin 203 includes messaging code for sending and receiving messages with messaging plugins on all gaming machines in a designated group. Messaging service plugin 203 also includes EGM participation tracking code for determining which gaming machines will be included in the set of gaming machines for each group gaming mode activation. Prize object tracking code tracks the state of prize objects in the game board, receiving messages indicating prize objects have been awarded, recording the state of the prize objects, and sending messages to the set of gaming machines that prize objects have been taken. Finally, messaging service plugin 203 includes mode change control code which determines when to activate and deactivate the group gaming mode, and sends messages to manage the activation and deactivation to the set of gaming machines included in a group gaming mode, as further described with respect to FIG. 5.

Referring again to gaming module 202, a module digest is typically including a content GUID (global unique identifier), game and version information, and data needed to validate the game module at installation and startup.

Referring to FIG. 3 and FIG. 4, the process functionality is controlled by the system processor by executing program code, executable by a gaming machine or gaming network processor, to accomplish the functionality as described herein. It should be understood that this is only one example embodiment, and other versions may divide the processing tasks of the game method in a different manner. For example, some systems may employ a thin client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring "at the gaming machine." In the depicted flowcharts, the method is performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (403). To perform the base game and group gaming mode of FIG. 3, the thin client version of the process, performed at the game server, further includes receiving game play requests originating from electronic gaming machine, and sending commands to the gaming machine to show reels spinning, the graphical accumulation object, the bonus round selection process, and results being displayed. The division of game logic steps between gaming machines and servers is known in the art and may be accomplished according to suitable methods allowed for the relevant gaming jurisdictions.

FIG. 5 is a flow diagram of a process for operating a group gaming mode messaging service plugin like plugin 203 of FIG. 4. The process begins at block 500 where the group gaming mode messaging service plugin is started. At block 502, the process maintains the individual play mode at the group of gaming machines such as the EGM's 100 in FIG. 8. While four gaming machines are shown in this group, a messaging service may manage many more gaming machines in a group, and may manage multiple groups. Alternately, a separate instance of the messaging service may execute for each group of gaming machines configured for group mode play.

At block 504, the process determines the current set of EGMs that will participate in a group gaming mode. In some embodiments, all EGMs in the group will participate in every group mode. In other embodiments, an active player credit account at a gaming machine qualifies it for the group gaming mode. In still others, a particular wagering level such as a number of lines bet or a special side wager may qualify the gaming machines to participate in the mode. To make this determination, the process may send and receive messages to the gaming machines indicating the status of credit accounts at the gaming machines and the wagering level currently set at the gaming machine. While blocks 502 and 504 are depicted in a particular order, typically block 504 updates the currently qualifying set of gaming machines on an event driven basis responsive to changes in the wagering level at the gaming machine.

At block 506, the process checks whether a group mode activation occurs. Again, this step is typically event driven. In this embodiment, a timer provides a group gaming mode activation at designated times. These times may be periodic, or at randomized offsets from a designated period of time. Other embodiments may use a characteristic from the gaming machines, such as cumulative amount wagered at the qualifying gaming machines, to activate a group gaming mode. Still other embodiments may make a random determination to start a group gaming mode. If no group gaming mode activation occurs, the process maintains the individual game mode at block 502. If a group gaming mode activation occurs, the process goes to block 508.

To start a group gaming mode at block 508, process transmits messages to all EGM's in the set, the qualifying gaming machines, to begin a group gaming mode. Typically the EGM's finish any primary game presentation that is in process when the message is received before changing their mode, however in some embodiments the secondary display may indicate a group gaming mode is starting while a primary game presentation is finishing. Generally primary game rounds that participate in the group gaming mode are those with a wager activation after the group gaming mode has begun at the participating gaming machines.

After activating the group gaming mode, the process at block 510 where it maintains the group game board by receiving messages from the messaging plugins at the participating gaming machines that prize objects have been awarded. These messages typically include an identifier for the prize object that was awarded and may include a credit amount and a timestamp of the award time. To maintain the group game board across the set of gaming machines, the process at block 512 transmits a message to all of the other EGM's in the set (besides the machine at which the prize object was awarded) indicating that a prize object has been taken. This triggers the gaming machines to remove the prize object from their group game board and display an indication that it has been taken. In this manner, the group game board at secondary display area 48 is maintained identically across all participating gaming machines. As the group gaming mode progresses, the prize objects 72 gradually disappear from the group game board as they are awarded at a particular gaming machine.

At block 514 the process determines whether to end the group gaming mode. In this embodiment, the determination is made based on a set time period expiring for the group gaming mode. This feature encourages player wagering in the group gaming mode because it appears as if prizes objects will be "left on the table" if they are not all awarded before the group gaming mode expires. In other embodiments, the decision to end the group gaming mode may be made based on other factors. For example, the group gaming mode may end when all prize objects on the game board are awarded, or a particular designated prize on the game board is awarded.

If the process does not decide to end the group gaming mode at block 514, it returns to block 510 where it continues to receive messages from the participating EGM's when prize objects are awarded. If the process decides to end the group gaming mode at block 514, it goes to block 516 where it transmits a message to all EGM's in the set commanding them to end the group gaming mode. In response to this message, as indicated with respect to FIG. 3, the gaming machines remove the group game board from secondary display area 48 and return the functionality of the gaming machine back to the normal primary game mode.

While the example embodiment described herein uses a single set of prize objects in the group gaming board during the group gaming mode, other embodiments may employ multiple game boards in the group gaming mode. For example, when all prize objects on a board are awarded, the board may fill again with more prize objects and display a different theme. This feature may be used when a group gaming mode is designated to last a certain period of time and the time has not expired when the final prize object is awarded. This feature may also be used in order to encourage wagering during the group gaming mode, for example if the average wagering level among the set of participating gaming machines is above a certain level, the process may decide not to end the group gaming mode and instead present a second group game board when all prize objects on the group game board are awarded. In such case, if the average wagering level does not qualify, the process may decide to end the group gaming mode when all prize objects on the group game board are awarded. An award of a particular designated prize object may also trigger the group gaming mode to activate such an additional set of prize objects.

Figure 6:
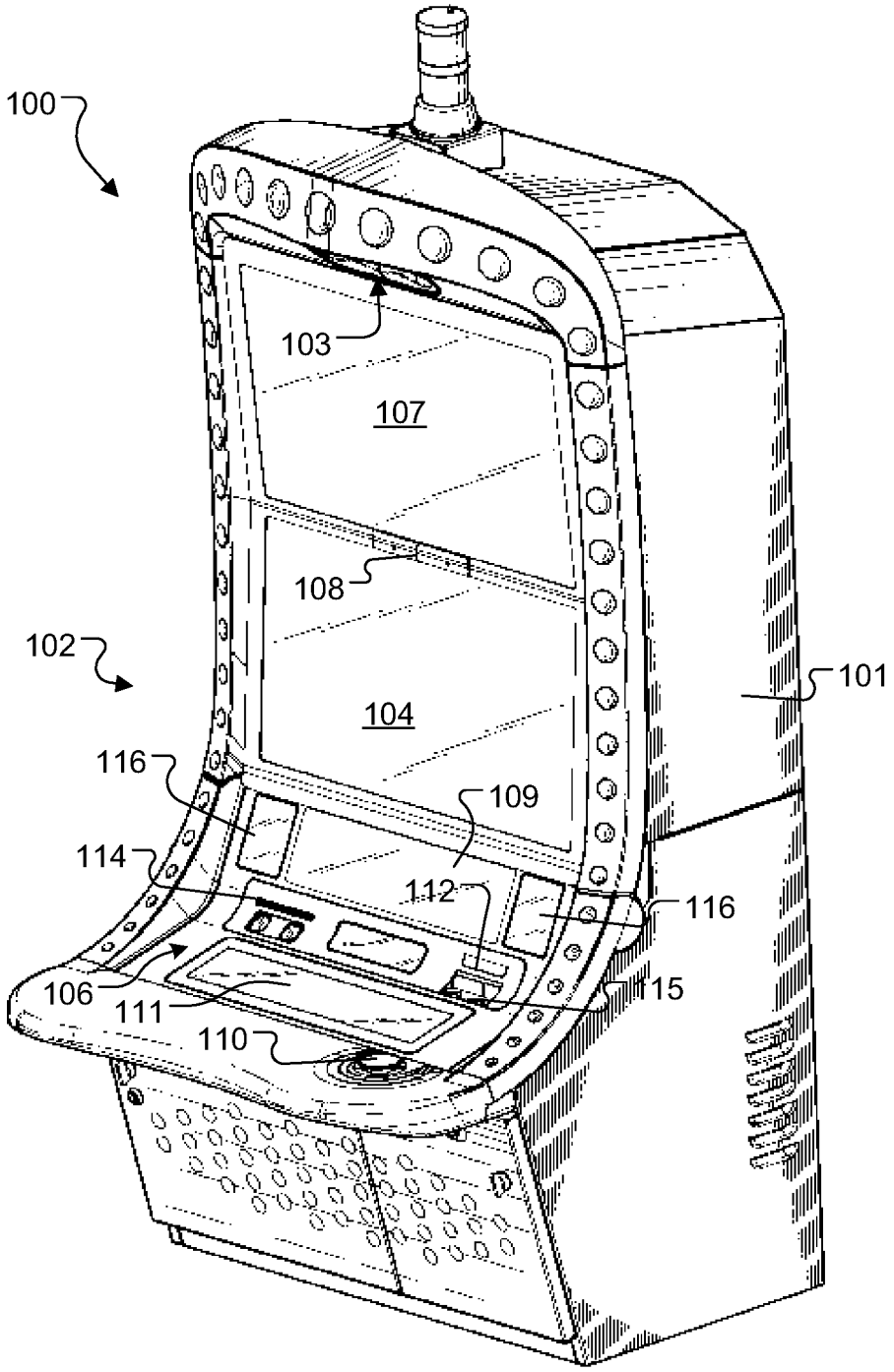
FIG. 6 is a front perspective view of a gaming machine which may be used in a gaming system according to some embodiments.
Figure 7:
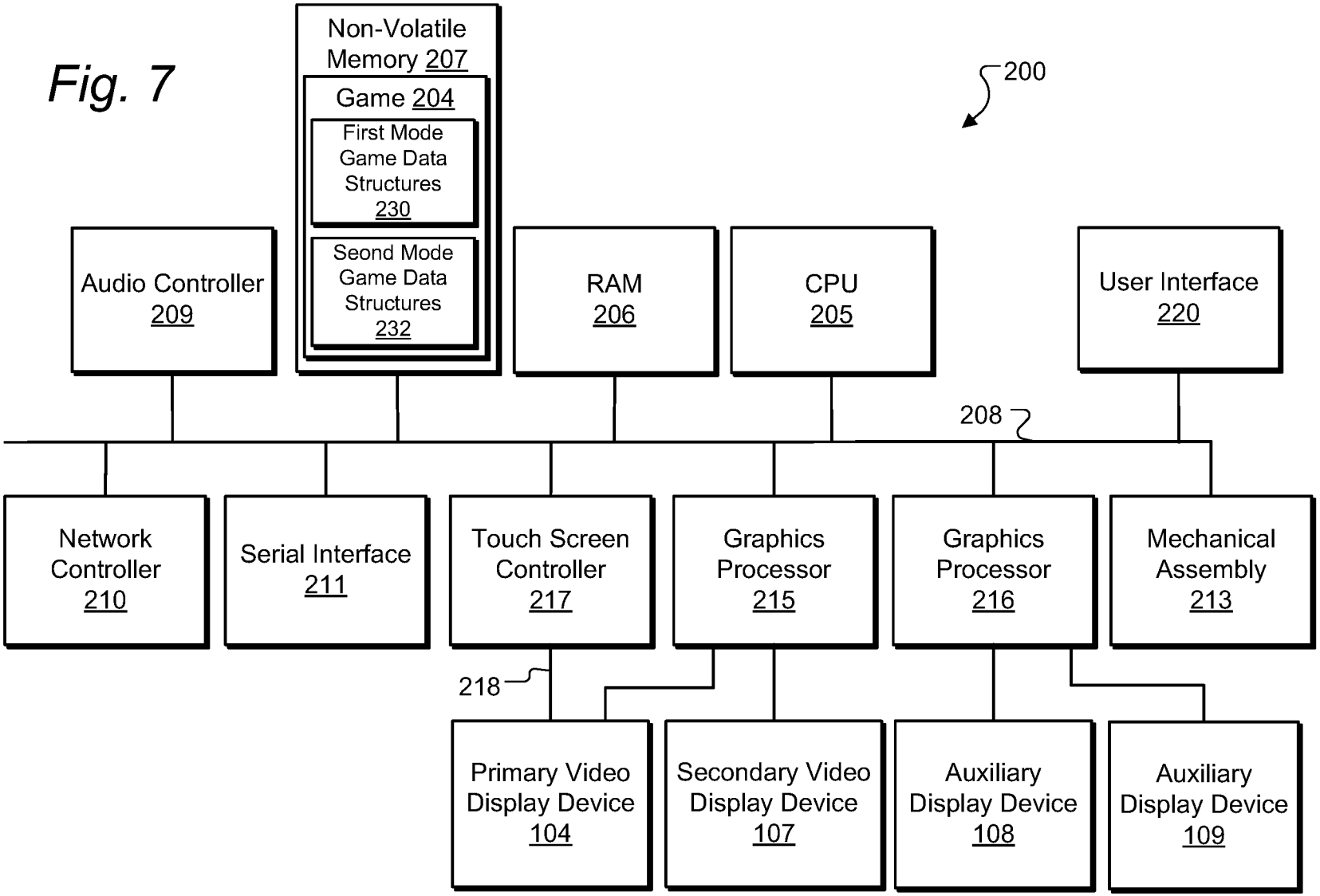
FIG. 7 is a block diagram showing various electronic components of the gaming machine shown in FIG. 5 together with additional gaming system components.

FIG. 6 shows a gaming machine 100 that may be used to implement feature games according to the present invention. The block diagram of FIG. 7 shows further details of gaming machine 100. Referring to FIG. 5, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. All of the displays may include touchscreen sensors, especially display 109 which may be used to present touchscreen controls for wagering. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 5 also includes a number of mechanical control buttons 110 mounted on ledge 106. These control buttons 110 may allow a player to select a bet level, select paylines, select a type of game or game feature, and actually start a play in a primary game. Further, primary video display device 104 in gaming machine 100 provides a convenient display device for implementing touchscreen controls.

Gaming machine 100 may also include a number of other player interface devices in addition to devices that are considered player controls for use in playing a particular game. The ledge may also include a hardware special object including a button, touch sensor, or switches, joysticks, or other mechanical input devices, and/or virtual buttons and other controls implemented on a suitable touchscreen video display. Gaming machine 100 also includes a currency/voucher acceptor having an input ramp 112, a player card reader having a player card input 114, and a voucher/receipt printer having a voucher/receipt output 115. One or more of these devices provides a credit input device in communication with the controller and adapted for accepting a physical item associated with a monetary value that establishes a player credit balance. Audio speakers 116 generate an audio output to enhance the user's playing experience.

FIG. 5 shows a gaming machine 100 that may be used to implement feature games according to the present invention. The block diagram of FIG. 6 shows further details of gaming machine 100. Referring to FIG. 6, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 may also be connected to a group display device mounted above a group of machines (typically at least 4 machines which may be side by side or arranged in a circle). An auxiliary display device 109 may present touchscreen player controls for entering wager levels and other commands. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 6 also includes a number of mechanical control buttons 110 mounted on ledge 106. These control buttons 110 may allow a player to select a bet level, select paylines, select a type of game or game feature, and actually start a play in a primary game. Further, primary video display device 104 in gaming machine 100 provides a convenient display device for implementing touchscreen controls.

It will be appreciated that gaming machines may also include a number of other player interface devices in addition to devices that are considered player controls for use in playing a particular game. The ledge may also include a hardware special object including a button, touch sensor, or switches, joysticks, or other mechanical input devices, and/or virtual buttons and other controls implemented on a suitable touchscreen video display. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 7 shows a logical and hardware block diagram 200 of gaming machine 100 which includes a central processing unit (CPU) 205 along with random access memory 206 and nonvolatile memory or storage device 207. All of these devices are connected on a system bus 208 with an audio controller 209, a network controller 210, and a serial interface 211. A graphics processor 215 is also connected on system bus 208 and is connected to drive primary video display device 104 and secondary video display device 107 (both mounted on cabinet 101 as shown in FIG. 6). A second graphics processor 216 is also connected on system bus 208 in this example to drive the auxiliary display device 109 also shown in FIG. 6. Gaming machine 100 also includes a touch screen controller 217 connected to system bus 208. Touch screen controller 217 is also connected via signal path 218 to receive signals from a touchscreen element associated with primary video display device 104. It will be appreciated that the touchscreen element itself typically comprises a thin film that is secured over the display surface of primary video display device 104. The touchscreen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 7 are known elements used in the gaming machine industry. These elements are preferably mounted in a computer chassis which is housed in cabinet 101 shown in FIG. 6. Alternatively, the various electronic components may be mounted on one or more circuit boards or modules housed within cabinet 101 without a separate enclosure. Those familiar with data processing systems and the various data processing elements shown in FIG. 7 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 7 as being connected directly on system bus 208 may in fact communicate with the other system components through a suitable expansion bus. Audio controller 209, for example, may be connected to the system via a PCI bus. System bus 208 is shown in FIG. 7 merely to indicate that the various components are connected in some fashion for communication with CPU 205 and is not intended to limit the invention to any particular bus architecture. Numerous other variations in the gaming machine internal structure and system may be used without departing from the principles of the present invention.

Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display device included with gaming machine 100. Also, a gaming machine implementing the present invention is not limited to any particular number of video display devices or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game that may be available through the gaming machine, and may also implement a game client for directing one or more display devices at the gaming machine to display the feature game mode according to the present invention. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs, while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included.

It should be noted that the invention is not limited to gaming machines employing the arrangement of processing devices and interfaces shown in example gaming machine 100. Other gaming machines through which the features herein are implemented may include one or more special purpose processing devices to perform the various processing steps for implementing the present invention, such as generating random numbers or checking the security status of software packages or gaming credit vouchers. Unlike processing devices such as CPU 205, these special purpose processing devices may not employ operational program code to direct the various processing steps.

Still referring to the hardware and logical block diagram 200 showing an example design for a gaming machine 100, the depicted machine in operation is controlled generally by CPU 205 which stores operating programs and data in memory 207 with game module 204, and software or drivers for user interface 220, network controller 210, audio/visual controllers, along with a controller for reel assembly 213 (if a mechanical reel configuration is used). The game module 204, once installed, also is held in non-volatile memory of the EGM, preferably a separate flash drive or hard drive from the memory holding the EGM operating system. CPU or game processor 205 may comprise a conventional microprocessor, such as an Intel microprocessor, mounted on a printed circuit board with supporting ports, drivers, memory, software, and firmware to communicate with and control gaming machine operations, such as through the execution of coding stored in memory 207 including one or primary game modules 202, including executable code and data structures such data structures for performing the primary game in the mode 230, and data structures for performing the primary game in the second, group gaming mode 232. Game processor 205 connects to user interface 220 such that a player may enter input information, and game processor 205 may respond according to its programming, such as to apply a wager and initiate execution of a game.

Game processor 205 also may connect through network controller 210 to a gaming network, such as example casino server network 400 shown in FIG. 8. Referring now to FIG. 8, the casino server network 400 may be implemented over one or more site locations and include host server 401, and an EGM configuration server 406 (in the preferred version the Everi Games Nitro Host server) for managing the configuration of multiple EGMs 100 on the network. A group display device 408 is coupled to network 400 may include its own controller and graphics processor for driving the group display in response to commands received over a network connection. The network may also include remote game play server 403 (which may be configured to provide game processor functionality including determining game outcomes and providing audio/visual instructions to a remote gaming device), a floor messaging server 404, central determinant server 405 (which may be configured to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

Referring to FIG. 7, a block diagram of an example casino server network system 400 associated with one or more gaming facilities is shown, including one or more networked gaming machines 100 in accordance with one or more embodiments. While some of the servers have been shown separately, they may be combined or split into additional servers having additional capabilities.

As shown, networked gaming machines 100 (EGM1-EGM4) and one or more overhead group displays 408 may be network connected and enable the content of one or more displays of gaming machines 100 to be mirrored or replayed on an overhead display. EGMs 100 may also feed celebration graphics directly to the overhead displays 408 in the course of providing games, for example to show a celebration for a large bonus win or group gaming mode win on a particular EGM 100. Typically the overhead display function and group celebration scenarios are managed by a floor messaging server such as Nitro floor messaging server 404, which receives messages from EGM's 100 to communicate group gaming mode wins, bonus game wins, or awards of other large prizes such as progressive prizes. The primary display content may also be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective player's video images may be displayed on overhead display 408 along with the content of the player's gaming machine 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Progressive prizes may be made available to be won through display on the group gaming board in group gaming mode, as they are in base gaming mode. Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Apple iPhone, Android phone, tablet, phablet, virtual reality device, iPad, etc.). To enter the website, a player may log in with a username (that may be associated with the player's account information stored on player account server 409 or be accessible by a casino operator to obtain player data and provide promotional offers), play various games on the website, make various personalizing selections and save the information, so that during a next gaming session at a casino establishment, the player's playing data and personalized information may be associated with the player's account and accessible at the player's selected gaming machine 100.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method performed with a group of gaming machines, each including one or more displays, a wager input device, and at least one electronic controller operatively coupled to the wager input device and the one or more displays and configured to execute instructions for providing a wagering game, the method comprising:

(a) operating the gaming machines in a first mode in which wager results of a primary game are presented in a primary display area, and wager results have a chance of including bonus events including a presentation on a secondary display area of the one or displays;

(b) in response to a game mode change event, operating a set of two or more of the gaming machines in a second group gaming mode in which the secondary display areas of the set of gaming machines include a common, persistent game board with a plurality of prize objects, the second group gaming mode comprising:

obtaining primary game results for wager activations at the set of gaming machines, the primary game results having a chance to include a prize amount;

providing selected primary game results at least partially in the game board by awarding at least one of the prize objects and an associated prize amount to one of a group of gaming machines to provide the primary game result prize amount in order to appear as if the prize amount were won from a game in the secondary display area;

for each prize object awarded, causing a message to be sent to the other gaming machines of the set that the at least one prize object has been taken, displaying an indication at the other gaming machines of the set that the at least one prize object is no longer available, and removing it from the game board in order to appear as if prize opportunities are being reduced as prize objects are removed from the secondary display area; and when a prize object is awarded, maintaining available prize distributions of the primary game for all gaming machines in the set.

2. The method of claim 1, further comprising maintaining the game board with a service running on a server coupled to the group of gaming machines over a network, the service receiving messages from the gaming machines in the set indicating that prize objects have been awarded, and in response recording that the prize objects have been taken and sending messages to the other gaming machines that the prize objects have been taken.

3. The method of claim 2, further comprising:

at the service running on the server, determining to start the second group gaming mode and causing the game mode change event to occur at the set of gaming machines; and at the service running on the server, determining to end the second group gaming mode and causing another game mode change event to occur at the set of gaming machines.

4. The method of claim 1, wherein the second group gaming mode further comprises, in response to obtaining one of the primary game results, determining that the prize amount is equal to an award of a prize object that has been taken, and selecting two or more alternative ones of the prize objects to be awarded for said primary game result.

5. The method of claim 1, wherein the second group gaming mode further comprises determining that all of the prize objects have been taken and, in response, providing a second common, persistent game board at the secondary display areas of the set of gaming machines with a plurality of additional prize objects available to be awarded similarly to the prize objects.

6. The method of claim 1, wherein the second group gaming mode further comprising, in response to a designated one of the prize objects being awarded at a selected one of the set of gaming machines, changing a graphic theme of the second group gaming mode at the selected gaming machine while maintaining the game board at the selected gaming machine.

7. The method of claim 1, wherein the selected primary game results are primary game results which would be entitled to a bonus event if occurring in the first mode.

8. A gaming machine comprising:

a display, an audio device, a wager input device, and at least one electronic controller operatively coupled to the wager input device, the audio device, and the display and configured to execute instructions related to a wagering game and to cause cash value credits to be awarded to a player in response to wagering wins;

tangible, non-transitory electronically accessible memory coupled to the at least one electronic controller and containing program code executable by the at least one electronic controller for:

(a) operating the gaming machine in a first mode in which wager results of a primary game are presented in a primary display area, and wager results have a chance of including bonus events including a presentation on a secondary display area of the one or more displays;

(b) in response to a gaming mode change event, operating the gaming machine with a set of two or more gaming machines in a second group gaming mode in which the secondary display areas of the set of gaming machines include a common, persistent game board with a plurality of prize objects, the second group gaming mode comprising:

obtaining primary game results for wager activations at the set of gaming machines, the primary game results having a chance to include a prize amount;

providing selected primary game results at least partially in the game board by awarding at least one of the prize objects and an associated prize amount to one of the set of gaming machines to provide the primary game result prize amount in order to appear as if the prize amount were won from a game in the secondary display area;

for each prize object awarded, causing a message to be sent to the other gaming machines of the set that the at least one prize object has been taken, displaying an indication at the other gaming machines of the set that the at least one prize object is no longer available, and removing it from the game board in order to appear as if prize opportunities are being reduced as prize objects are removed from the secondary display area; and when a prize object is awarded, maintaining available prize distributions of the primary game for all gaming machines in the set.

9. The gaming machine of claim 8, further comprising maintaining the game board with a service running on a server coupled to the set of gaming machines over a network, the service receiving messages from the gaming machines in the set indicating that prize objects have been awarded, and in response recording that the prize objects have been taken and sending messages to the other gaming machines that the prize objects have been taken.

10. The gaming machine of claim 9, further comprising:

at the service running on the server, determining to start the second group gaming mode and causing the gaming mode change event to occur at the set of gaming machines; and at the service running on the server, determining to end the second group gaming mode and causing another game mode change event to occur at the set of gaming machines.

11. The gaming machine of claim 8, wherein the second group gaming mode further comprises, in response to obtaining one of the primary game results, determining that the prize amount is equal to an award of a prize object that has already been taken, and selecting two or more alternative ones of the prize objects to be awarded for said primary game result.

12. The gaming machine of claim 8, wherein the second group gaming mode further comprises determining that all of the prize objects have been taken and, in response, providing a second common, persistent game board at the secondary display areas of the set of gaming machines with a plurality of additional prize objects available to be awarded similarly to the prize objects.

13. The gaming machine of claim 8, wherein the second group gaming mode further comprising, in response to a designated one of the prize objects being awarded at a selected one of the set of gaming machines, changing a graphic theme of the second group gaming mode at the selected gaming machine while maintaining the game board at the selected gaming machine.

14. The gaming machine of claim 8, wherein the selected primary game results are primary game results which would be entitled to a bonus event if occurring in the first mode.

15. A tangible, non-transitory computer readable medium holding a program product for execution by controllers of a set of two or more gaming machines each having one or more video displays, the program product including machine instructions for:

operating a credit input device in communication with the controller to accept a physical item associated with a monetary value and, in response, establishing a player credit balance;

controlling a plurality of player-activated input devices in communication with the controller for activating wagers and setting wagers covered by the credit balance;

operating the set of gaming machines in a first mode in which wager results of a primary game are presented in a primary display area, and wager results have a chance of including bonus events including a presentation on a secondary display area of the one or displays;

in response to a gaming mode change event, operating the set of two or more gaming machines in a second group gaming mode in which secondary display areas of the set of gaming machines include a common, persistent game board with a plurality of prize objects, the second group gaming mode comprising:

obtaining primary game results for wager activations at the set of gaming machines, the primary game results having a chance to include a prize amount;

providing selected primary game results at least partially in the game board by awarding at least one of the prize objects and an associated prize amount to one of the set of gaming machines to provide the primary game result prize amount in order to appear as if the prize amount were won from a game in the secondary display area;

for each prize object awarded, causing a message to be sent to the other gaming machines of the set that the at least one prize object has been taken, displaying an indication at the other gaming machines of the set that the at least one prize object is no longer available, and removing it from the game board in order to appear as if prize opportunities are being reduced as prize objects are removed from the secondary display area; and when a prize object is awarded, maintaining available prize distributions of the primary game for all gaming machines in the set.

16. The computer readable medium holding a program product of claim 15, further wherein the second group gaming mode further comprises maintaining the game board with a service running on a server coupled to the set of gaming machines over a network, the service receiving messages from the gaming machines in the set indicating that prize objects have been awarded, and in response recording that the prize objects have been taken and sending messages to the other gaming machines that the prize objects have been taken.

17. The computer readable medium holding a program product of claim 16, wherein the second group gaming mode further comprises:

at the service running on the server, determining to start the second group gaming mode and causing the game mode change event to occur at the set of gaming machines; and at the service running on the server, determining to end the second group gaming mode and causing another game mode change event to occur at the set of gaming machines.

18. The computer readable medium holding a program product of claim 15, wherein the second group gaming mode further comprises, in response to obtaining one of the primary game results, determining that the prize amount is equal to an award of a prize object that has already been taken, and selecting two or more alternative ones of the prize objects to be awarded for said primary game result.

19. The computer readable medium holding a program product of claim 15, wherein the second group gaming mode further comprises determining that all of the prize objects have been taken and, in response, providing a second common, persistent game board at the secondary display areas of the set of gaming machines with a plurality of additional prize objects available to be awarded similarly to the prize objects.

20. The computer readable medium holding a program product of claim 15, wherein the selected primary game results are primary game results which would be entitled to a bonus event if occurring in the first mode.

* * * * *